US006726128B2

(12) United States Patent
Schempp

(10) Patent No.: US 6,726,128 B2
(45) Date of Patent: Apr. 27, 2004

(54) DOUBLE-SWITCHING VALVE FOR FUEL INJECTION SYSTEM

(75) Inventor: Stefan Schempp, Wernau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/345,364

(22) Filed: Jan. 16, 2003

(65) Prior Publication Data

US 2003/0146306 A1 Aug. 7, 2003

(30) Foreign Application Priority Data

Jan. 16, 2002 (DE) ..... 102 01 470

(51) Int. Cl.[7] ..... F02M 59/00

(52) U.S. Cl. ..... 239/533.2; 239/92; 239/88; 239/102.2

(58) Field of Search ..... 239/533.2, 90, 239/92, 88, 102.2; 123/506, 503, 458, 500, 446, 479, 501

(56) References Cited

U.S. PATENT DOCUMENTS 4,618,095 A * 10/1986 Spoolstra ..... 239/90
4,653,455 A * 3/1987 Eblen et al. ..... 123/506
5,524,826 A * 6/1996 Mueller et al. ..... 239/88
6,089,470 A * 7/2000 Teerman et al. ..... 239/88

* cited by examiner

*Primary Examiner*—Dinh Q. Nguyen
(74) *Attorney, Agent, or Firm*—Ronald E. Greigg

(57) ABSTRACT

A unite injector a unit injector for injecting fuel into the combustion chamber of a self-igniting internal combustion engine, including a pump part a nozzle part and an final control element that is followed downstream by a hydraulic coupler which actuates a valve needle of a 2/2-way valve inside a nozzle body. The final control element includes a piezoelectric crystal array. The hydraulic coupler acts on the face end of the valve needle in such a way that it can be put into a first position that enables a pressure buildup, and a further position of the valve needle that enables the opening of a nozzle needle, with the pressure buildup and the valve opening being separately adjustable.

10 Claims, 4 Drawing Sheets

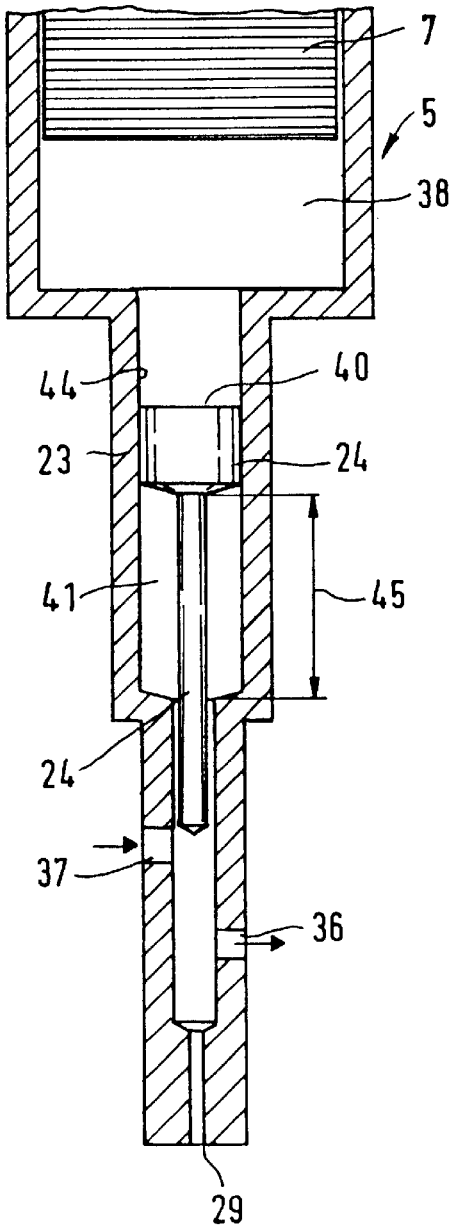
Fig. 2.1
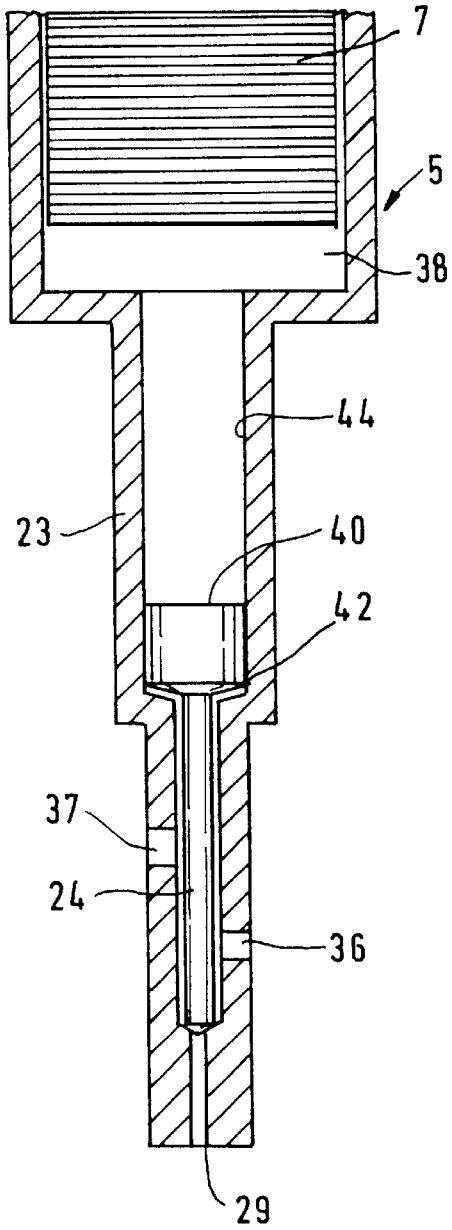
Fig. 2.2

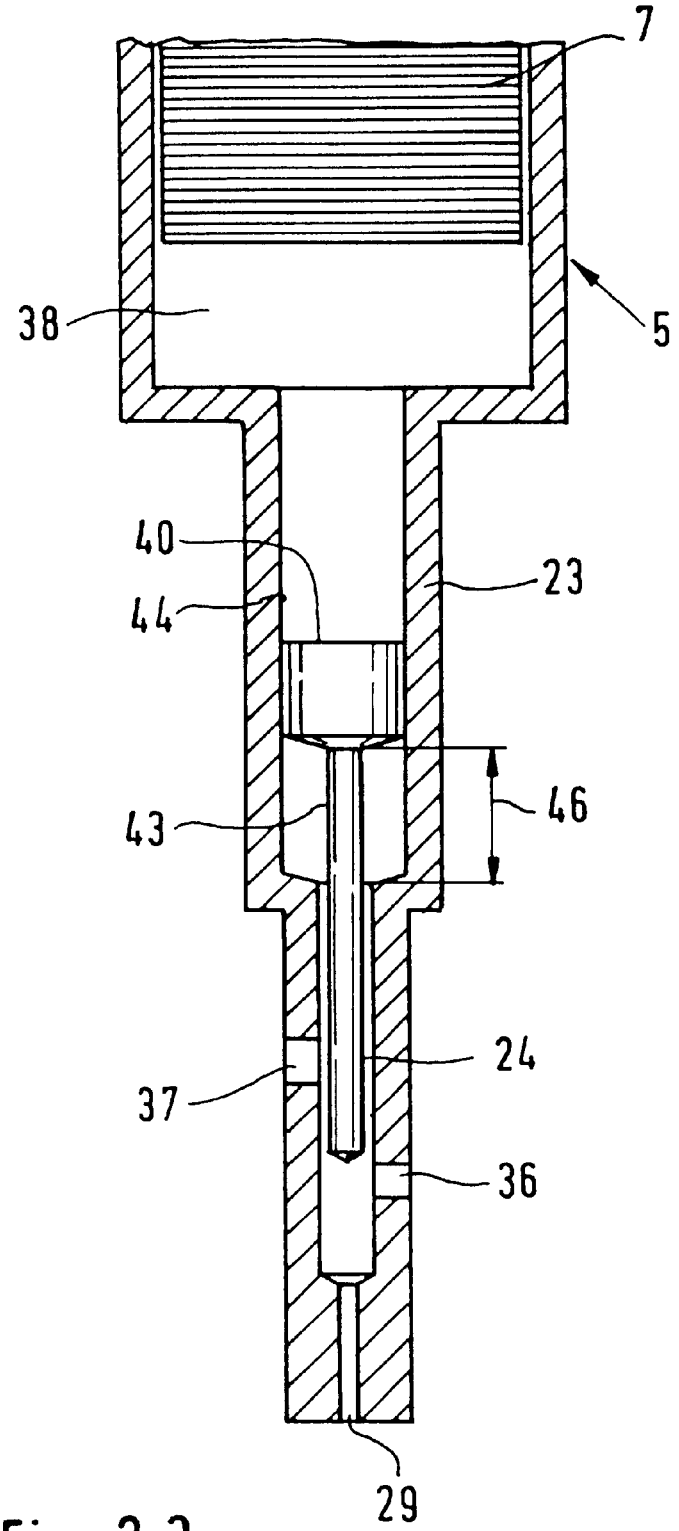
Fig. 2.3

DOUBLE-SWITCHING VALVE FOR FUEL INJECTION SYSTEM

BACKGROUND OF THE INVENTION

1. Field of the Invention

In injection systems of the UIS (unit injector system) type, a final control element, via a hydraulic coupler, closes the high-pressure chamber of a fuel injection pump. In the UI systems, the pressure is built up by means of a piston. When a certain value is reached, the pressure opens the injection valve.

2. Description of the Prior Art

With pump-nozzle systems (UIS or unit injector systems), mechanically-hydraulically controlled injection phases are presently generated in self-igniting internal combustion engines, and these phases contribute on the one hand to noise abatement and on the other to minimizing pollution. In unit injection systems, a distinction is made among four operating states. A pump piston is moved upward via a restoring spring. The fuel, which is under constant overpressure, flows out of the low-pressure part of the fuel supply via the inlet bores, integrated with the engine block, and the inlet conduit into a valve chamber of a magnet valve. The magnet valve is opened. Via a connecting bore, the fuel enters the high-pressure chamber.

Upon a rotation of the drive cam, the pump piston moves downward. The magnet valve remains in its open position, and the fuel is pressed by the pump piston, via the return conduit, into the low-pressure part of the fuel supply.

In a third phase of the injection event, when an electromagnetic valve is used, the coil of the electromagnet is supplied with current at a certain instant by the control unit, so that the magnet valve needle is pulled into a seat, and the communication between the high-pressure chamber and the low-pressure part is closed. This instant is also known as the "electrical injection onset". The fuel pressure in the high-pressure chamber rises continuously as a result of the motion of the pump piston, and as a result a rising pressure is also established at the injection nozzle. When a nozzle opening pressure of approximately 300 bar is reached, a lifting of the nozzle needle occurs, causing fuel to be injected into the combustion chamber. This instant is also called the "actual injection onset", or as the supply onset. Because of the high pumping rate of the pump piston, the pressure continues to rise further during the entire injection event. In a concluding operating state, the coil of the electromagnet is switched off again, after which, after a slight delay time, the magnet valve opens, and the communication between the high-pressure chamber and the low-pressure part is again opened. In this transition phase, the peak pressure is reached, which depending on the pump type varies between a maximum of 1800 and a maximum of 2050 bar. After that, the pressure collapses very quickly. When it falls below the nozzle closing pressure, the injection nozzle closes and terminates the injection event. The remaining fuel pumped by the pump element until the apex point of the drive cam is forced into the low-pressure part of the fuel system via the return conduit.

As a rule, such unit injector systems, used for instance in injection systems for trucks, include two final control elements embodied as electromagnets. When there are two final control elements, the unit injector system requires more space, which when such injection systems are used in utility vehicles is available. It is therefore easily possible to accommodate the final control elements embodied as magnet valves in Diesel engines for trucks. In passenger cars, however, there is only limited space available in the engine compartment, especially in the upper region of the cylinder block, and this codetermines the outer dimensions of a unit injector system. If instead of final control elements in the form of two electromagnet valves, only one electromagnet valve is used, then there is the disadvantage that the valve can be kept in an intermediate position only highly imprecisely and at high effort and expense in terms of regulation.

OBJECT AND SUMMARY OF THE INVENTION

The advantage of the embodiment proposed according to the invention is above all that the closure of the high-pressure chamber of the unit injector system can be controlled separately for the pressure buildup and for the opening of the nozzle needle. Thus the injection pressure, that is, the pressure at which the nozzle needle opens, can be varied freely.

If a piezoelectric actuator is used, then its stroke length can be varied arbitrarily by varying the voltage at the piezoelectric actuator. The final control element, embodied as a piezoelectric actuator, of the unit injector can be followed downstream by a hydraulic pressure booster, in order to achieve the requisite stroke lengths within the housing of the unit injector. An final control element embodied as a piezoelectric actuator can be switched to various switching positions by means of supplying suitable current. In the voltage-free state of the piezoelectric actuator without any current, the nozzle needle assumes an open position; that is, fuel is pumped at low pressure by the fuel feed pump through the unit injector. In this position of the nozzle needle, the low-pressure side inlet and the inlet to a high-pressure side pump chamber communicate with one another by a short circuit, since the openings corresponding to them inside the housing of the unit injector are uncovered by the nozzle needle.

At maximum current supply to the piezoelectric final control element, the nozzle needle is moved downward; that is, the low-pressure side inlet and the high-pressure side inlet to the pump chamber are both closed. The pressure buildup begins in this phase, without the nozzle needle being opened by the steadily rising pressure. Conversely, once the desired injection pressure has been built up in the unit injector, the current supply to the piezoelectric final control element is withdrawn, as a result of which the nozzle needle opens with pressure reinforcement.

The end of the injection is brought about by opening the return, which causes the closure of the nozzle needle. With this provision, with an final control element embodied as a piezoelectric actuator, the pressure buildup and the opening of the nozzle needle can be controlled separately from one another in a unit injector, which allows freedom of choice in terms of the injection pressure built up.

BRIEF DESCRIPTION OF THE DRAWING

The invention will be better understood and further objects and advantages thereof will become more apparent from the ensuing detailed description of preferred embodiments taken in conjunction with the drawings, in which:

FIG. 2.1 shows a piezoelectric actuator with a hydraulic coupling chamber in a first switching position;

FIG. 2.2 shows the piezoelectric final control element with a downstream hydraulic coupling chamber, with the nozzle needle fully closed;

FIG. 2.3 shows the piezoelectric final control element with the downstream hydraulic coupling chamber in an intermediate position that is triggered with pressure reinforcement.

DESCRIPTION OF THE PREFERRED EMBODIMENTS

Figure 1:
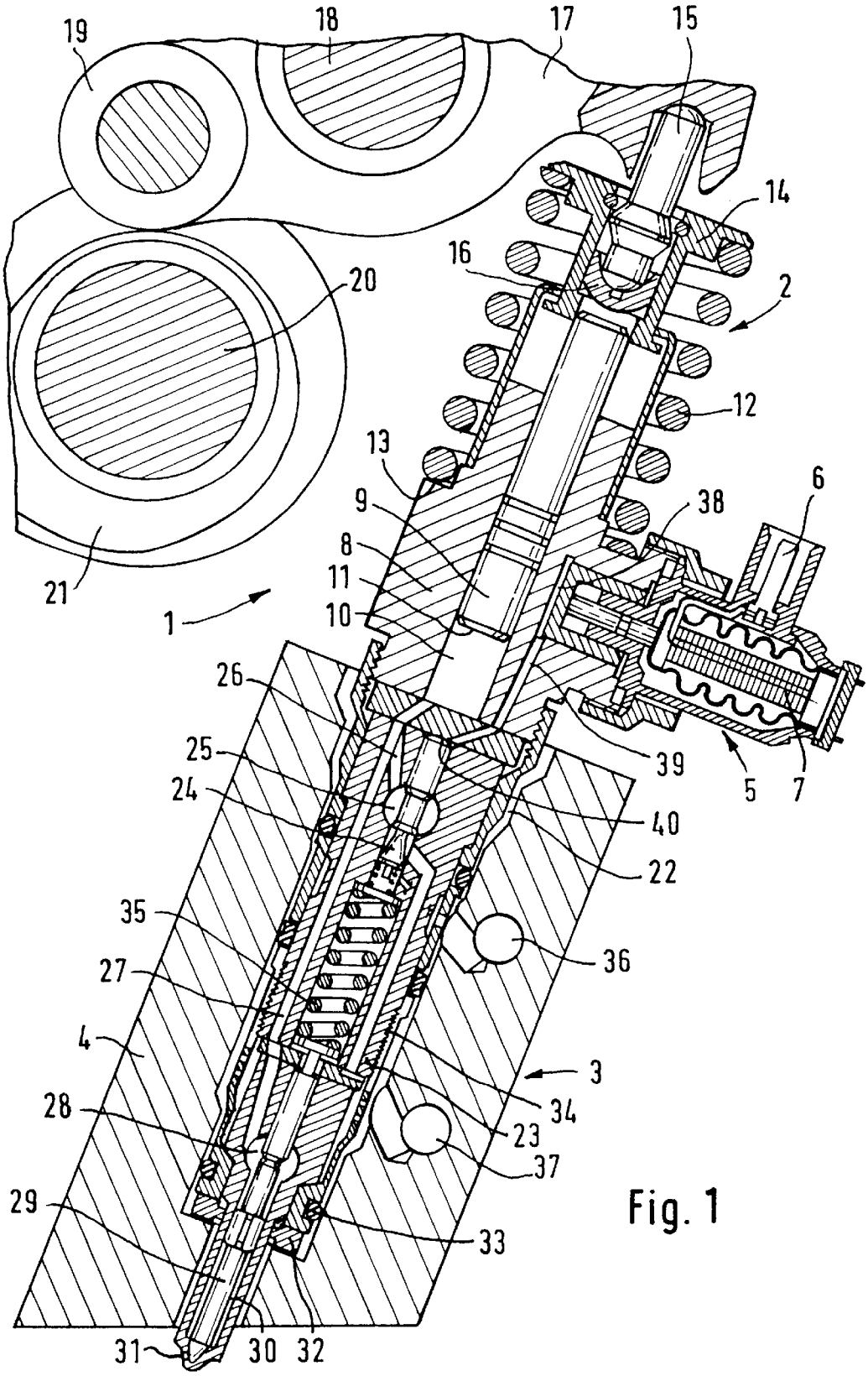
FIG. 1 shows a unit injector that is actuatable by means of a magnet valve.

FIG. 1 shows a unit injector, which is actuatable with an final control element embodied as a piezoelectric actuator.

It can be seen from the illustration in FIG. 1 that the unit injector 1 shown there includes both a pump part 2 and a nozzle part 3. The nozzle part 3 of the unit injector 1 is let into the cylinder head 4 of a self-igniting internal combustion engine not shown in further detail. The nozzle part 3 of the unit injector 1 is screwed into a cylinder head bore 22 and is received sealingly in the cylinder head bore 22 by means of both a spacer disk 32 and O-rings 33.

An final control element 5, which is embodied as a piezoelectric final control element and which includes a piezoelectric crystal array in stacked form, is received laterally on the pump part 2 of the unit injector 1. The electrical triggering of the piezoelectric crystal stack 7 is effected via a plug connection 6 received laterally on the final control element 5. The final control element 5 is received laterally on the pump housing 8 of the pump part 2 of the unit injector 1 and acts upon a hydraulic coupler 38, which via a coupler line 39 acts on the end face of a valve needle 24 disposed displaceably in a nozzle body 23 of the nozzle part 3. A pump piston 9 is let into the pump housing 8 of the pump part 2 of the unit injector 1 and is actuated under camshaft control via a tilt lever 17. The face end 11 of the pump piston 9 defines a pressure chamber 10 in the pump housing 8.

The pump piston 9 is moved in the axial direction in the pump housing 8 and is prestressed by a spring element 12, embodied here as a spiral spring. The spring element embodied as a spiral spring 12 is braced on one end on a collar 13 of the pump housing 8 and on the other on a spring plate 14 that is penetrated by a pressure bolt 15. The pressure bolt 15 is braced on one end on a ball-socketlike element 16 and acts upon the face end, remote from the pump chamber 10, of the pump piston 9. The pressure bolt 15, which is received with its lower end in a bolt socket 16, is surrounded, on its end facing the bolt socket 16, by a tilt lever 17 that is rotatable about a tilt lever shaft 18. On the end of the tilt lever 17 opposite the pressure bolt 15, a tilt lever roller 19 is rotatably supported, which with its outer circumferential face rolls on an eccentric cam 21 that is embodied on a camshaft 20. By means of the outer circumferential contour of the eccentric cam 21, the axial motion of the pump piston 9, transmitted via the tilt lever 17, is generated inside the pump housing 8.

The nozzle body 23 of the nozzle part 3 is let into the cylinder head bore 22 and includes a valve needle 24, which is moved in the axial direction inside the nozzle body 23. The upper face end 40 of the valve needle 24 communicates via the coupler line 39 with the hydraulic coupler 38, which in turn is acted upon by the piezoelectric crystal stack array 7 of the final control element 5. Moreover, the valve needle 24 of the 2/2-way valve in the nozzle body 23 is acted upon a restoring spring. The restoring spring, which is associated with the face end of the valve needle 24 remote from the face end 40, is braced in turn on a disklike element, which is acted upon by a nozzle needle spring 35. A high-pressure line branches off from the pump chamber 11 in the pump housing 8 of the pump part 2 and via the control chamber inlet 26 acts upon the control chamber 25 of the valve needle 24, and at the same time, via the nozzle chamber inlet 27, it acts with fuel that is at high pressure upon the nozzle chamber 28 in the nozzle body 23, which chamber receives the nozzle needle 29 that is received displaceably in the nozzle body 23. From the nozzle chamber 28, the fuel that is at high pressure flows via an annular gap 30 in the direction of the nozzle tip, where at least one injection opening 31 is embodied that protrudes into a combustion chamber, not shown in FIG. 1, of a self-igniting internal combustion engine. The nozzle needle 29 is guided in the end toward the combustion chamber of the nozzle body 23 and is prestressed by the nozzle needle spring 35. The axial position of the nozzle body 23 in the cylinder head 4 is determined by the thickness of a spacer disk 32. The sealing function between the combustion chamber and the cylinder head 4 is performed by the spacer disk 32 and by a number of O-rings 33.

Located laterally of the nozzle body 23 inside the cylinder head 4 is a fuel return, identified by reference numeral 36, that is disposed above a fuel inlet, identified by reference numeral 37, to the nozzle body 23. The nozzle body 23 communicates with the part oriented toward the combustion chamber of the self-igniting internal combustion engine via a nozzle lock nut 34. This nut tightens the two parts of the nozzle body 23 against one another and creates a fuel-tight connection between the pump chamber 10 of the pump part 2 and the high-pressure inlets 26, 27 to the control chamber 25 and nozzle chamber 28, respectively.

FIG. 2.1 shows a piezoelectric final control element with a hydraulic coupling chamber, which is put into a first switching position.

In the first position 41, shown in FIG. 2.1, of the valve needle 24 in the nozzle body 23, the piezoelectric crystal stack array 7 of the final control element 5 is not being supplied with current. Accordingly, the hydraulic coupler 38 is not acted upon. The valve needle 24 in the nozzle part 3 of the unit injector 1 has moved upward by a first stroke length 45, relative to its seat toward the nozzle body. In this switching position, the inlet 37, which is schematically shown in FIGS. 2.1, 2.2 and 2.3 as disposed above the return 36 in the nozzle body 23, and the return 36 are both open. In the voltage-free state, shown in FIG. 2.1, of the final control element 5, the valve needle 24 is open; the fuel is pumped by the fuel feed pump at low pressure through the nozzle part 2 of the unit injector 1. In this first position 41 of the valve needle 24, the final control element 5, or in other words its piezoelectric crystal stack array 7, is not being supplied with current, which corresponds to the voltage level shown in FIG. 3 before the ascending edge 50 of the voltage.

Figure 3:
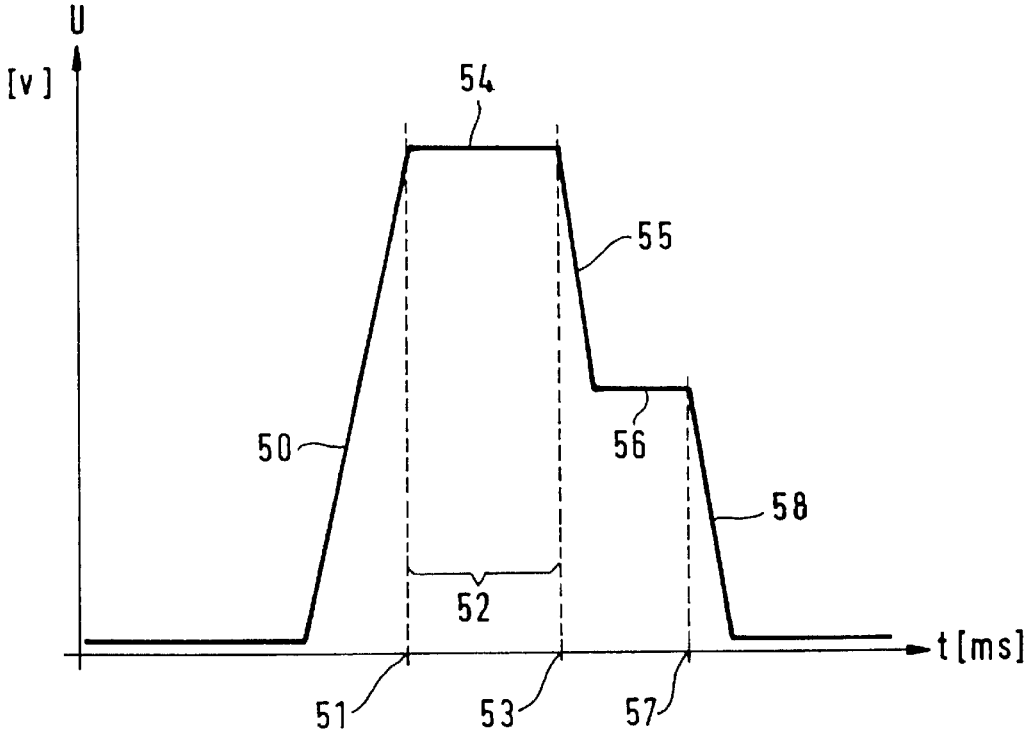
FIG. 3 shows the voltage profile with which the piezoelectric actuator can be triggered.

In FIG. 2.2, the piezoelectric final control element with the downstream hydraulic coupler 38 is being supplied with maximum voltage, corresponding to the first voltage level 54 shown in FIG. 3. As a result, the piezoelectric crystal stack array 7 of the final control element 5 moves into the hydraulic coupler 38 in such a way that via the coupler line 39, shown in FIG. 1, the face end 40 of the valve needle 24 is acted upon by high pressure. As a result, the valve needle 24 of the 2/2-way valve moves downward all the way inside the needle guide 44 and closes both the inlet 37 and the return 36. In the second position 42, shown in FIG. 2.2, of the valve needle 24, the pressure buildup takes place in the high-pressure chamber, that is, in the pump chamber 10 of the pump part 2. The second position 42 of the valve needle 24 is maintained during the pressure buildup phase 52.

During the pressure buildup phase 52 (see the voltage profile in FIG. 3), the pressure buildup takes place in the high-pressure chamber, that is, in the pump chamber 10 inside the pump housing 8, until a desired pressure level is reached.

FIG. 2.3 shows the piezoelectric final control element with the downstream hydraulic coupler in a further, third position 43.

For attaining a switching state of the valve needle 24 corresponding to the third position of the valve needle 24, the current supply to the piezoelectric crystal stack array 7 of the final control element 5 is withdrawn to a second voltage level 56 (see FIG. 3). The voltage drops along a first descending voltage edge 55 from the first voltage level 54, which is maintained during the second position 42 of the valve needle 24, back to a second, lower voltage level 56 (see FIG. 3).

Because of this, the pressure in the hydraulic coupler 38 and in the coupler line 39 drops, so that the valve needle 24, whose face end 40 is acted upon by the high pressure, moves upward by a second stroke length 46 in the vertical direction relative to the nozzle body 23. In the third position 43 of the valve needle 24, the return 36 is opened, while the inlet 37 remains closed by the valve needle 24, analogously to what is shown in FIG. 2.2. The nozzle needle 29 (see FIG. 1) is as a result opened with pressure reinforcement. The injection ends by opening of the return 36, since the opening of the return 36 has the effect of an immediate pressure reduction and the closure of the nozzle needle 29.

FIG. 3 shows the voltage profile with which the piezoelectric final control element, in the form of a piezoelectric actuator, that double-switches the 2/2-way valve is triggered.

In the state of the piezoelectric final control element 5 when it is not being supplied with current, the voltage is equivalent to the level that prevails in FIG. 3 before the ascending edge 50 of the voltage. The pressure buildup phase 52 is generated by the ascending edge 50 of the voltage up to a first voltage level 54. The supply onset is indicated by reference numeral 51. The pressure buildup phase 52 can be kept variable and is independent, that is, separate, from the triggering of the nozzle needle 29 by actuation of the valve needle 24. During the pressure buildup phase, the piezoelectric final control element 5 is supplied with current at the first voltage level 54. The pressure buildup takes place without the unit injector being opened by the nozzle needle 29 as a result of the pressure being built up in the pump chamber 10. As soon as the desired injection pressure level and the desired instant for the injection onset 53 is reached, the first voltage level 54 is lowered to a second voltage level 56. While the first voltage level 54 prevails, the valve needle 24 of the 2/2-way valve of the unit injector 1 is in the second position, which is marked 42 in the FIG. 2.2; that is, both the inlet 37 and the return 36 to the pump chamber 11 are closed. If the first voltage level 54 is lowered along the first, descending voltage edge 55 to the second voltage level 56, a relief of the hydraulic coupler 38 takes place, since the piezoelectric crystal array 7 contracts upon the application of a low voltage level corresponding to the second voltage level 56. Accordingly, the valve needle 24 moves by the second stroke length 46, shown in FIG. 2.3, into its third position. In the third position, the inlet 37 is still closed, while the return 36 to the pump chamber 11 remains open. The second voltage level 56 prevails until the end of supply 57 by the fuel pump and then drops along a further, second, descending voltage edge 58 to the 0 level. At the 0 level of the voltage V, the valve needle 24 again assumes the first position 41 shown in FIG. 2.1, in which the nozzle needle traverses a first stroke length 45 inside the nozzle body 23, and in which the inlet 37 and the return 36 are short-circuited to one another. By means of the valve needle 24 of the 2/2-way valve inside the nozzle body 23, the closure of the high-pressure chamber, that is, of the pump chamber 10 of the pump part 2, is controlled separately from one another for the pressure buildup and for the opening of the nozzle needle 29. The injection pressure can be controlled freely in accordance with the instant of triggering of the final control element 5, at which the first voltage level 54 is lowered to the second voltage level 56, and the pressure buildup phase remains unaffected.

The foregoing relates to preferred exemplary embodiments of the invention, it being understood that other variants and embodiments thereof are possible within the spirit and scope of the invention, the latter being defined by the appended claims.

I claim:

1. In a unit injector (1) for injecting fuel into the combustion chamber of a self-igniting internal combustion engine, having a pump part (2), a nozzle part (3) and a final control element (5) that is followed downstream by a hydraulic coupler (38, 39) by way of which a valve needle (24) of a 2/2-way valve inside a nozzle body (23) is actuatable, the improvement wherein the final control element (5) comprises a piezoelectric crystal array (7) acting on the hydraulic coupler (38, 39) which acts upon one face end (40) of the valve needle (24) to put the valve needle (24) into a first position (41) that enables a pressure buildup, and a second position (42) of the valve needle (24) that enables the opening of a nozzle needle (29), whereby the pressure buildup and the valve opening are adjustable independently.

2. The unit injector in accordance with claim 1, wherein the hydraulic coupler (38, 39) in the nozzle body (23) changes over into a needle guide (44) that guides the valve needle (24).

3. The unit injector in accordance with claim 1, further comprising a control chamber inlet (26) and a nozzle chamber inlet (27) branching off from the pump chamber (10) of the pump part (2) and simultaneous act upon a control chamber (25) of the valve needle (24) and a nozzle chamber (28) surrounding the nozzle needle (29).

4. The unit injector in accordance with claim 1, wherein, viewed in the longitudinal direction of the nozzle needle (29) in the nozzle body (23), a fuel inlet (37) is disposed above a return (36).

5. The unit injector in accordance with claim 4, wherein in the first position (41) of the valve needle (24), with no current being supplied to the final control element (5), the fuel inlet (37) and the return (36) in the nozzle body (23) are open.

6. The unit injector in accordance with claim 5, wherein in the first position (41) of the valve needle (24), a first stroke length (45) of the valve needle (24) is established, at which the fuel inlet (37) and the fuel return (36) are open.

7. The unit injector in accordance with claim 4, wherein when current at a first voltage level (54) is supplied to the final control element (5), the inlet (37) and the return (36) are closed by the valve needle (24), and a pressure buildup phase (52) takes place in the pump chamber (10) of the pump part (2).

8. The unit injector in accordance with claim 4, wherein after a pressure buildup phase (52) in the pump chamber (10) of the pump part (2) has elapsed, at an injection onset (53), the final control element (5) is subjected to a second voltage level (56), and the nozzle needle (29) opens, with pressure reinforcement.

9. The unit injector in accordance with claim 8, wherein the injection onset (53) and the pressure buildup phase (52) are controllable separately from one another by means of closure of the pump chamber (10).

10. The unit injector in accordance with claim 8, wherein in a third position (43) of the valve needle (24), a second stroke length (46) of the valve needle (24) is established, at which the fuel return (36) to the pump chamber (10) is opened.

* * * * *